US005222636A

United States Patent [19]

Meuresch

[11] Patent Number: 5,222,636

[45] Date of Patent: Jun. 29, 1993

[54] APPARATUS FOR SPRAYING A LIQUID FROM A CONTAINER

[75] Inventor: Herbert Meuresch, Uiesbaden, Fed. Rep. of Germany

[73] Assignee: Precision Valve Corporation, Yonkers, N.Y.

[21] Appl. No.: 780,428

[22] Filed: Oct. 23, 1991

Related U.S. Application Data

[63] Continuation of Ser. No. 722,394, Jun. 19, 1991, abandoned, which is a continuation of Ser. No. 649,153, Jan. 1, 1991, abandoned, which is a continuation of Ser. No. 584,376, Sep. 17, 1990, abandoned, which is a continuation of Ser. No. 384,042, Jul. 24, 1990, abandoned, which is a continuation of Ser. No. 265,317, Oct. 27, 1988, abandoned, which is a continuation of Ser. No. 144,759, Jan. 19, 1988, abandoned, which is a continuation of Ser. No. 45,158, Apr. 21, 1987, abandoned, which is a continuation of Ser. No. 824,924, Jan. 31, 1986, abandoned, which is a continuation of Ser. No. 327,091, Dec. 3, 1991, abandoned.

[30] Foreign Application Priority Data

Dec. 3, 1980 [DE] Fed. Rep. of Germany ..... 3045565

[51] Int. Cl.[5] ..... B67D 88/54

[52] U.S. Cl. ..... 222/321; 222/402.19; 222/464; 239/334

[58] Field of Search ..... 222/321, 341, 342, 320, 222/332, 376, 380, 382, 383, 385, 402.1, 402.19, 464; 239/333, 334

[56] References Cited

U.S. PATENT DOCUMENTS

| | | | |
|---|---|---|---|
| 994,938 | 6/1911 | Larimore | 222/376 |
| 2,132,035 | 10/1938 | Leipold | 222/376 X |
| 2,256,902 | 9/1941 | Huthsing | 222/376 X |
| 3,315,693 | 4/1967 | Braun | 137/43 |
| 3,542,254 | 11/1970 | Samuelson | 222/402.19 |
| 4,277,001 | 7/1981 | Nozawa | 222/376 X |
| 4,371,098 | 2/1983 | Nozawa et al. | 222/376 X |
| 4,775,079 | 10/1988 | Grothoff | 222/376 X |
| 4,942,985 | 7/1990 | Schultz | 222/464 X |

FOREIGN PATENT DOCUMENTS

| | | | |
|---|---|---|---|
| 2817393 | 10/1979 | Fed. Rep. of Germany . | |
| 2019497 | 10/1979 | United Kingdom . | |
| 2058229 | 4/1981 | United Kingdom | 222/402.19 |
| 3045565 | 6/1982 | United Kingdom | 222/376 |

*Primary Examiner*—Gregory L. Huson

*Attorney, Agent, or Firm*—Davis, Hoxie, Faithfull & Hapgood

[57] ABSTRACT

A pump sprayer for pharmaceutical or cosmetic products provides for consistent spray regardless of the orientation of the container. A gravity-actuated valve element coacts with a valve seat to close a secondary passage to the pump when the container is in a normal upright position. In an inverted position the valve opens and the pump intakes from the secondary passage which draws from the area of the top of the container, opposite the primary pump dip tube intake at the base of the container. The valve casing which includes the valve seat has an insertion aperture for the valve element, as well as an axial slot to insure communication of the secondary passage with the pump when the container is in the inverted position.

27 Claims, 2 Drawing Sheets

APPARATUS FOR SPRAYING A LIQUID FROM A CONTAINER

Figure 1:
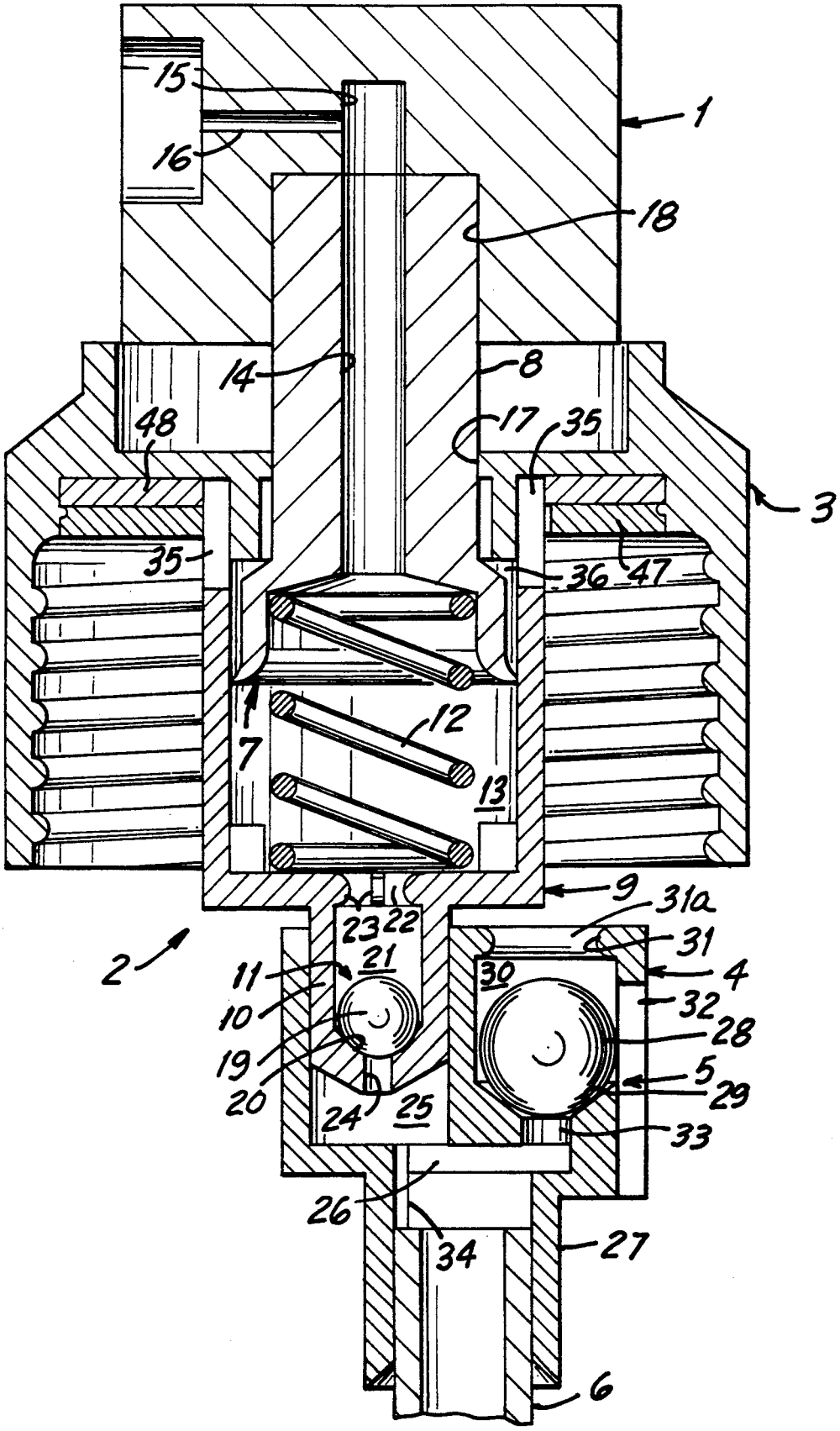

This is a continuation of copending application Ser. No. 07/722,394, filed on Jun. 19, 1991, now abandoned, which is a continuation of Ser. No. 07/649,153, filed Jan. 1, 1991, now abandoned, which is a continuation of Ser. No. 07/584,376, filed Sep. 17, 1990, now abandoned, which is a continuation of Ser. No. 07/384,042, filed Jul. 24, 1990, now abandoned, which is a continuation of Ser. No. 07/265,317, filed Oct. 27, 1988, now abandoned, which is a continuation of Ser. No. 07/144,759, filed Jan. 19, 1988, now abandoned, which is a continuation of Ser. No. 07/045,158, filed Apr. 21, 1987, now abandoned, which is a continuation of Ser. No. 06/824,924, filed Jan. 31, 1986, now abandoned, which is a continuation of Ser. No. 06/327,091, filed Dec. 3, 1981, now abandoned.

The invention relates to an apparatus for spraying a liquid from a container, comprising a plunger pump, the casing of which can be arrested in a liquid-tight way in an aperture in the container, and the conveying chamber of which can be connected via a suction valve and a suction tube, directly with that part of the container chamber that is at the bottom in the normal position, and can be connected to the open air by way of an outlet passage extending through the plunger and plunger rod in an axial direction.

The preferred application for such a sprayer is in the field of cosmetic and pharmaceutical products.

A known sprayer of the above type cannot spray the liquid in the container when the container is in the head-forward position, because in this position the free end of the suction tube is above the level of the liquid in the container.

There are various known methods of dealing with this difficulty.

One solution to the problem is to arrange a flexible bag in the container, the bag containing the liquid and having the suction tube of the sprayer extending into it. Spraying of the liquid reduces the volume of the bag accordingly, so that the free end of the suction tube remains in the liquid. However, the bag represents an additional expense as does its assembly, and it is moreover difficult to assemble.

In another known solution the bottom of the container contains an aperture leading into the open air. Over the aperture and within the container is a plunger which takes up the cross-section of the container, and the container chamber above the plunger is filled with the liquid. When a spraying action is applied the plunger is sucked upwards by the low pressure which forms in the liquid chamber, so that the sprayer always extends into the liquid even in the head-forward position. Apart from the additional cost of the plunger, this solution has the disadvantage that the plunger, which forms the bottom of the liquid chamber, becomes stuck in the container, if the container is not accurately worked or if bumps form in it during transportation or use. Again it may not be possible for the liquid to be sprayed when the container is in the head-forward position.

The invention aims to provide an apparatus of the above type, that will enable the liquid in the container to be sprayed even in the head-forward position of the container, with low material, manufacturing and assembly costs.

According to the invention this is achieved, in that a secondary passage leads from part of the container chamber that is at the top in the normal position, to the suction aperture of the suction valve, and that a gravity-actuated auxiliary valve is formed in the secondary passage, blocks the passage in the normal position of the container and frees it in the head-forward position.

This solution necessitates only the formation of the secondary passage and the auxiliary valve therein. This involves only a small outlay in material and can easily be carried out. The auxiliary valve can be mounted in the container at the same time as the spray-means. In particular, an auxiliary valve casing separate from the pump casing may be arranged between the pump casing and the suction tube. A conventional spray with a plunger pump may be used unchanged. Then the auxiliary valve may be manufactured and assembled separately from the conventional spray, while all the components can be fitted into the container together once assembled. In that case a connecting piece on the pump casing, forming the suction valve casing, may extend into the auxiliary valve casing adjacent to the auxiliary valve. This simplifies the assembly of the pump casing and auxiliary valve casing, while at the same time ensuring that the auxiliary valve and thus the secondary passage are as high as possible in the container chamber that is uppermost in the normal position of the container. In the head-forward position of the container virtually all the liquid can be sprayed without any substantial residue being left in the container, since the spraying action stops only when the liquid level in the head-forward position of the container is below the entry point of the secondary passage.

Provision may also be made for an external part of the pump casing to be formed integrally with the auxiliary valve casing; for the suction valve chamber and the auxiliary valve chamber to be juxtaposed; and for the auxiliary valve chamber to be covered by an insert formed in the outer part of the pump casing and connecting the suction valve chamber to the conveying chamber of the plunger pump. This construction simplifies the manufacture of the entire casing, particularly one made of plastics, including preliminary mounting of the valves before the insert and casing are assembled.

It is then ad advantage for the auxiliary valve casing to come within the cross-sectional outline of the pump casing. This makes it possible to use containers where the neck aperture has a relatively small internal diameter, since the spray means has a correspondingly small external diameter.

If the insert is provided with a hollow attachment forming the suction valve casing, the insert and the suction valve can easily be pre-mounted before being fitted in the pump casing and auxiliary valve casing. The attachment on the insert may be guided into an appropriate bore in the auxiliary valve casing component, which also forms part of the main and secondary channel for discharge.

The suction valve chamber and auxiliary valve chamber may each contain an aperture for the insertion of a valve-closing member and the insertion aperture of the suction valve chamber may be partly closed by the insert. The closure members may be inserted in the appropriate valve chambers in a simple way and secured therein by the insert, without interferring with the communication between the conveying chamber of the pump and the suction valve chamber.

It is particularly advantageous for the member closing the auxiliary valve to be a ball which is larger in diameter than the minimum radial width of the chamber containing the suction valve. This facilitates the mounting of the member or closing the auxiliary valve. It is always inserted in the correct position in the auxiliary valve chamber, and there is no danger of it being inserted in that for which the suction valve is provided.

Figure 2:
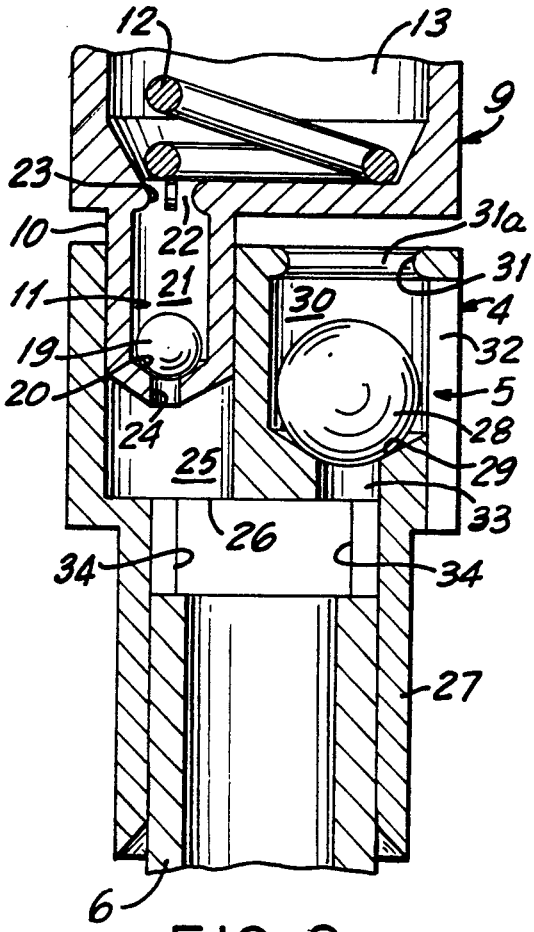
Figure 3:
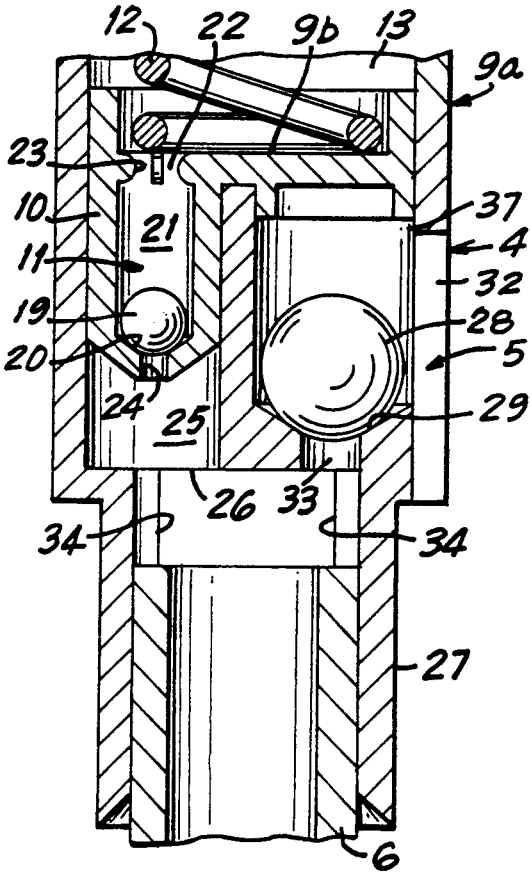
Figure 4:
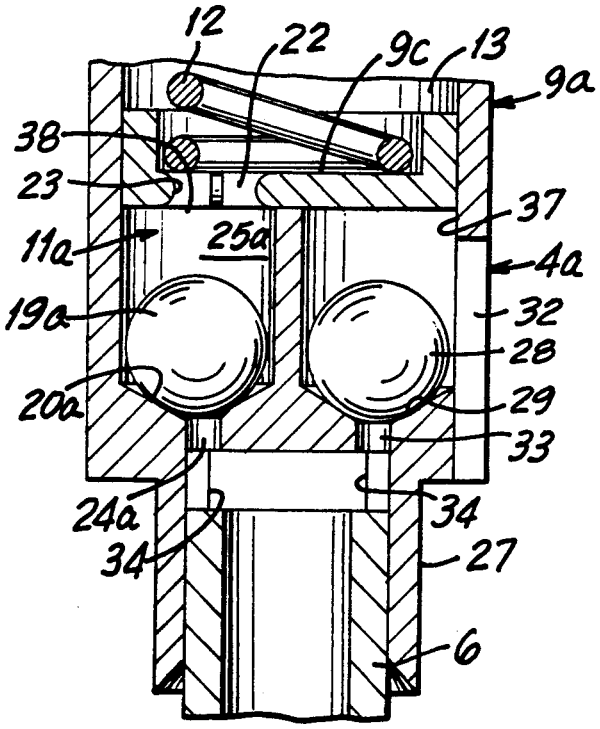

The invention and further developments of it will now be described in greater detail with reference to the accompanying drawings. These show preferred examples of the invention, and in them:

FIG. 1 is a vertical section through a first example of the sprayer according to the invention, FIG. 2 is a vertical section through part of a second example of the sprayer according to the invention, FIG. 3 is a vertical section through part of a third example of the sprayer according to the invention, and FIG. 4 is a vertical section through part of a fourth example of the sprayer according to the invention.

The sprayer shown in FIG. 1 comprises a spray head 1, a plunger pump 2, a hood 3 with internal thread for screwing on to a threaded aperture in a liquid container (not shown), an auxiliary valve casing 4 with an auxiliary valve 5 and a suction tube 6 (also known as a dip tube) extending to the bottom of the container.

The pump 2 has a plunger 7 with a plunger body 8; a casing 9, forming the cylinder for the plunger 7 and provided with a connecting piece 10 at the bottom; a suction valve 11 formed in the connecting piece 10; and a spring 12 between the plunger 7 and the bottom of the conveying chamber 13 of the pump 2. Apart from the spring 12 all the pump components are made of thermo plastics synthetic material.

The body 8 of the plunger contains an axial bore 14, which is continued in the spray head 1 in the form of the bore 15. From the bore 15 a radial bore 16 extends into the open air. The diameter of the bore 16 is small enough to impart a spraying action to the liquid which emerges from the conveying chamber 13 through the exit passage formed by the bores 14 to 16, when the spray head 1 and thus the plunger 7 are depressed.

The body 8 is guided in an aperture 17 in the top of the hood 3 and seated rigidly in a bore 18 in the spray head 1.

The suction valve 11 comprises a valve closure member in the form of a ball 19 and a conical valve seat 20. The valve chamber 21 is connected by an aperture 22 to the conveying chamber 13 of the pump 2. Resiliently yielding, radial projections 23 enable the ball 19 to be pushed through the aperture 22 on assembly, and allow the liquid sucked in by the plunger 7 to flow through, but prevent the ball 19 from coming out of the chamber 21 by itself. When the ball 19 is raised the valve chamber 21 then communicates with a casing chamber 25 by way of an aperture 24 extending coaxially through the valve seat 20. The connecting piece 10 is seated tightly sealed in the chamber 25, and the chamber is connected by an aperture 26, a connecting piece 27 at the underside of the auxiliary valve casing 4, and the suction tube 6 held by the connecting piece 27, to that part of the container chamber that is at the bottom in the normal position of the liquid container.

The auxiliary valve 5 has a closure member in the form of ball 28 and a conical valve seat 29 interacting with it. The hall 28 is in a valve chamber 30 formed in the auxiliary valve casing 4. The chamber 30 has an aperture 31*a* at the top, with a projection 31 extending radially inwards and round it in an annular shape, and an axial slot 32 extending through the outer wall of the chamber. When the ball 28 is lifted off the seat 29, the valve chamber 30 communicates, via an aperture 33 extending through the valve seat 29, the aperture 26, the connecting piece 27 and the suction tube 6, likewise with the upper part of the liquid container chamber in the head-forward position of the container and, via the slot 32, with what is the lower part of the chamber in the head-forward position.

A rib 34 projecting radially inwardly in the connecting piece 27 prevents the section tube 6 from being inserted in the connecting piece 27 as far as the lower edge of the aperture 33 during assembly, and breaking the connection to and from the valve chamber 30.

When liquid has to be sprayed from the container in he normal position of the container, i.e. when it is held upright with the spray-head 1 at the top, the spray-head 1 and thus the plunger 7 are first depressed against the force of the spring 12. The ball 19 is pressed against the valve seat 20, so that the suction valve 11 is closed and the air contained in the conveying chamber 13 expelled into the open through the outlet passage 14,15,16. When the spray-head 1 has been released the spring pushes the plunger 7 upwards, creating a low pressure in the conveying chamber 13 because of the throttling action of the bore 16. The low pressure causes the ball 19 to be lifted off the valve seat 20 and liquid to be sucked out of the lower part of the container chamber through the passage 6, 26,25,24,21,22 into the conveying chamber 13 of the pump 2, the auxiliary valve 5 being closed simultaneously. This closing is ensured both by the low pressure and by the dead weight of the ball 28. Further depression of the spray head 1 and plunger 7 causes the suction valve 11 to close and the liquid, now contained in the conveying chamber 13, to be expelled into the open through the exit passage 14,15,16 and sprayed at the outlet end of the bore 16. When the spray-head 1 has been released, the spring 12 again produces a return stroke of the plunger with refilling of the chamber 13, so that liquid can be sprayed again at the next operating stroke.

In the head-forward position of the liquid container, i.e. when the spray-head 1 is held downwards, both balls 19 and 28 drop down against the projections 23 and 31. Provided that in this position of the container the liquid level is higher than the lower edge of the aperture 26, the liquid can now flow through the secondary passage formed by the slot 32, the valve chamber 30 and the aperture 33, on through the aperture 26, the casing chamber 25, the aperture 24, the valve chamber 21 and the aperture 22, into the conveying chamber 13 and the length of passage 14,15, since any air contained in the chambers 21 and 13 escapes through the outlet passage, whereas the liquid is prevented from escaping at normal pressure by the throttling action of the bore 16. Only an operating stroke of the plunger 7 causes the liquid to be expelled through the passage 14,15,16 from the chamber 13, the suction valve 11 being closed simultaneously. At the return stroke which follows, liquid is again sucked through the secondary passage into the chamber 13, since the auxiliary valve 5 remains open because of the heavy dead weight of the ball 28, in opposition to which the suction pressure cannot press the bal 28 against the valve seat 29.

A connection from the container chamber to the open air, via the slots 35 in the wall of the pump casing 9, an intermediate chamber 36 between the plunger 7 and the casing 9 and a narrow throttling gap, provided between the body 8 of the plunger and the aperture 17 in the hood 3 which lets through air but no liquid, equalises the air pressure in the container.

As compared with a known sprayer consisting of the components 1,2,3 and 5, with the suction tube 6 pushed on to the connection piece 10, all that is therefore required to enable the sprayer to be used in the head-forward position is to interpolate the auxiliary valve casing 4, with the valve 5.

A sealing ring 47, bearing on the underside of the upper part of the hood with an intermediate ring 48, seals of the upper edge of the container aperture from the sprayer screwed on to it.

The upper part of the FIG. 2 example is no different from FIG. 1, so this part is not shown in FIG. 2. Substantially the only difference from FIG. 1 is the fact that the connecting piece 10 is mounted eccentrically on the pump casing 9 rather than coaxially; it has sufficient eccentricity to bring the auxiliary valve casing 4 within the outline of the pump casing 9. This sprayer is therefore appropriate for liquid containers with quite a small internal diameter or quite a small aperture.

Instead of having only on abutting rib 34 two such ribs are provided, while the diameter of the connecting piece 27 is somewhat larger than in the FIG. 1 example.

The difference between the example in FIG. 3 and that in FIG. 2 is that in FIG. 3 the outer part 9A of the pump casing is constructed integrally with the auxiliary valve casing 4 and the other part 9B as an insert. In this way no projection 31 is required in the insert aperture 37 of the auxiliary valve chamber 30. The diameter of the ball 28 is larger than the minimum width or internal diameter of the chamber 25 in which the connecting piece 10 is inserted. During assembly the ball 28 can therefore simply be thrown into the housing component 9A. It will nevertheless always drop into the auxiliary valve chamber 30.

The only way in which the example in FIG. 4 differs from that in FIG. 3 is in the fact that the insert 9C has no connecting piece 10 and the suction valve 11A is formed in the chamber 25A of the auxiliary value casing 4A. The ball 19A and valve seat 20A are therefore larger, and the aperture 24A is formed directly in the casing 4A. The ball 10A is inserted unobstructed through the aperture 38 before the insert 9C is fitted. Both balls 19A and 28 are the same size, so that is no distinction need to be made between them for assembly and storage. Altogether the manufacturing process is simpler.

In all the examples all parts of the spray head and casing are made of thermo plastic synthetic material. The balls which close the valves are preferably made of metal.

The invention also covers modifications. Thus the suction tube 6 may be pushed externally over the connecting piece 27. A non-return valve may be provided in the passage 14 or 15 and closed during the suction stroke of the plunger 7.

I claim:

1. Apparatus for spraying a liquid out of a container having a container aperture, the apparatus comprising a suction tube, a suction valve having a lower aperture and an upper aperture, a conveying chamber, an outlet passage, a casing, a plunger, a plunger body and a plunger pump wherein the suction tube conveys liquid from that part of the container that is at the bottom in the upright position of the container to the lower suction aperture, the lower suction aperture conveys the liquid from the suction tube to the suction valve, the upper suction aperture conveys the liquid from the suction valve to the conveying chamber, the conveying chamber conveys the liquid from the upper suction aperture to the outlet passage, and the outlet passage conveys the liquid from the conveying chamber to the open air by way of the outlet passage, wherein the outlet passage extends through the plunger and the plunger body in an axial direction, and the casing being capable of positioning in a liquid-tight manner in the container aperture;

said apparatus further comprising an auxiliary valve casing, a gravity actuated auxiliary valve, a secondary passage within the auxiliary valve casing, and a valve closing member, the auxiliary valve casing having an axial slot which provides an inlet opening to the secondary passage, the auxiliary valve casing also having an insertion aperture for inserting the valve closing member into the auxiliary valve casing, wherein said slot is an opening separate from the insertion aperture, wherein the secondary passage leads from a part of the container chamber that is, in the upright position, at the top of the container, to the lower suction aperture of the suction valve, and wherein the gravity actuated valve blocks the secondary passage in the upright position of the container, closing the auxiliary valve, and opens the secondary passage in the position when the container is reversed by about 180° with respect to the upright position of the container, opening the auxiliary valve and allowing liquid to flow through the axial slot and secondary passage to the lower suction aperture and to the conveying chamber.

2. The apparatus of claim 1, wherein in the upright position, the plunger opens the suction valve when released after being depressed, the suction valve otherwise being closed, and in the position when the container is reversed by 180° with respect to the upright position of the container, the plunger closes the suction valve when depressed, the suction valve otherwise being open, allowing liquid to flow through the suction valve to the conveying chamber.

3. The apparatus of claim 1, wherein the auxiliary valve casing is separate from the pump casing, and said secondary passage has a section between the auxiliary valve and the suction valve.

4. The apparatus of claim 1, wherein the pump casing further comprises a connecting piece defining the suction valve, and connecting the suction valve to the auxiliary valve casing.

5. The apparatus of claim 4, wherein said auxiliary valve casing further comprises a chamber adapted to receive the connecting piece.

6. The apparatus of claim 5, wherein the chamber is positioned adjacent to the auxiliary valve such that the secondary passage section has a small distance in height from the lower suction aperture.

7. The apparatus of claim 6, wherein the small distance in height is no greater than the diameter of the auxiliary valve closing member.

8. The apparatus of claim 1, wherein the axial slot and the secondary passage are as high as possible in the container such that there is a small distance in height between said slot and that part of the container chamber that is lowermost in the position when the container is reversed by about 180° with respect to the upright position of the container, the small distance being no smaller than the diameter of the auxiliary valve closing member.

9. The apparatus of claim 1, wherein the auxiliary valve casing lies essentially within the cross-sectional outline of the pump casing.

10. In an apparatus for spraying a liquid out of a container having a container aperture, the apparatus comprising a suction tube, a suction valve having a lower aperture and an upper aperture, a conveying chamber, an outlet passage, a casing, a plunger, a plunger body and a plunger pump, wherein the suction tube conveys liquid from that part of the container that is at the bottom in the upright position of the container to the lower suction aperture, the lower suction aperture conveys the liquid from the suction tube to the suction valve, the upper suction aperture conveys the liquid from the suction valve to the conveying chamber, the conveying chamber conveys the liquid from the upper suction aperture to the outlet passage, and the outlet passage conveys the liquid from the conveying chamber to the open air by way of the outlet passage extending through the plunger and the plunger body in an axial direction, the casing capable of being positioned in a liquid-tight manner in the container aperture;

said apparatus further comprising an auxiliary valve casing having a secondary passage, the secondary passage leading from a part of the container chamber that is at the top in the upright position of the container to the lower suction aperture of the suction valve;

said apparatus further comprising a gravity-actuated auxiliary valve formed in the secondary passage and at least partially defined by the auxiliary valve casing, wherein the auxiliary valve blocks the secondary passage in the upright position of the container, closing the auxiliary valve, and frees the passage in the position when the container is reversed by about 180° with respect to the upright position of the container, opening the auxiliary valve and allowing liquid to flow through the secondary passage to the lower suction aperture and to the conveying chamber, and wherein the auxiliary valve casing lies essentially within the cross-sectional outline of the pump casing, the outline defined by the axial direction of liquid flow.

11. The apparatus of claim 10, wherein in the upright position, the plunger opens the suction valve when the plunger is released after being depressed, the suction valve otherwise being closed, and in the position when the container is reversed by about 180°, with respect to the upright position of the container, the plunger closes the suction valve when depressed, the suction valve otherwise being open, allowing liquid to flow through the suction valve to the conveying chamber.

12. The apparatus of claim 10, wherein the suction valve and the auxiliary valve each have a valve closing member, and at least one of these valves has a second aperture formed therein for inserting the valve-closing member.

13. The apparatus of claim 10, further comprising an insert at least partially defining at least one of the valves and the conveying chamber of the plunger pump, the insert closing the auxiliary valve with respect to the conveying chamber.

14. The apparatus of claim 10, wherein the auxiliary valve and the secondary passage are integral with the pump casing and the auxiliary valve and the suction valve are positioned side by side.

15. The apparatus of claim 10, wherein the secondary passage has a section between the auxiliary valve and the suction valve, and there is at a small distance in height from the lower suction aperture to said section.

16. The apparatus of claim 15, wherein the small distance in height is no greater than the diameter of the auxiliary valve closing member.

17. The apparatus of claim 10, wherein the auxiliary valve casing has an axial slot which provides an inlet opening to the secondary passage, the slot and the secondary passage being positioned as high as possible in the container such that there is a small distance in height between the slot and that part of the container chamber that is lowermost in the position when the container is reversed by about 180° with respect to the upright position of the container, the small distance being no smaller than the diameter of the auxiliary valve closing member.

18. The apparatus of claim 10, wherein the auxiliary valve casing is separate from the pump casing, the pump casing further comprising a connecting piece defining the suction valve and connecting the suction valve to the auxiliary valve casing.

19. The apparatus of claim 18, wherein the auxiliary valve casing further comprises a chamber adapted to receive the connecting piece.

20. The apparatus of claim 19, wherein the chamber is positioned adjacent to the auxiliary valve such that the secondary passage section between the auxiliary valve and the suction valve has a small distance in height from the lower suction aperture.

21. The apparatus of claim 20, wherein the small distance in height is no greater than the diameter of the auxiliary valve closing member.

22. Apparatus for spraying a liquid out of a container having a container aperture, the apparatus comprising a suction tube, a suction valve having a lower aperture and an upper aperture, a conveying chamber, an outlet passage, a casing, a plunger, a plunger body and a plunger pump, wherein the suction tube conveys liquid from that part of the container that is at the bottom in the upright position of the container to the lower suction aperture, the lower suction aperture conveys the liquid from the suction tube to the suction valve, the upper suction aperture conveys the liquid from the suction valve to the conveying chamber, the conveying chamber conveys the liquid from the upper suction aperture to the outlet passage, and the outlet passage conveys the liquid from the conveying chamber to the open air by way of the outlet passage, wherein the outlet passage extends through the plunger and the plunger body in an axial direction, and the casing being capable of positioning in a liquid-tight manner in the container aperture;

said apparatus further comprising an auxiliary valve casing, a gravity actuated auxiliary valve, a secondary passage within the auxiliary valve casing, the auxiliary valve casing further having an axial slot which provides an inlet opening to the secondary passage, and a valve closing member, wherein the secondary passage leads from a part of the container chamber that is, in the upright position, at the top of the container, to the lower suction aperture of the suction valve and wherein the gravity-actuated auxiliary valve blocks the secondary passage in the upright position of the container, closing the auxiliary valve and opens the secondary passage in the position when the container is reversed by about 180° with respect to the upright position of the container, opening the auxiliary valve and allowing liquid to flow through the slot and secondary passage to the lower suction aperture and to the conveying chamber.

23. The apparatus of claim 22, wherein the auxiliary valve casing lies essentially within the cross-sectional outline of the pump casing.

24. The apparatus of claim 22, wherein in the upright position, the plunger opens the suction valve when the plunger is released after being depressed, the suction valve otherwise being closed, and in the position when the container is reversed by about 180° with respect to the upright position of the container, the plunger closes the suction valve when depressed, the suction valve otherwise being open, allowing liquid to flow through the suction valve to the conveying chamber.

25. In an apparatus for spraying a liquid out of a container having a container aperture, the apparatus comprising a suction tube, a suction valve having a lower aperture and an upper aperture, a conveying chamber, an outlet passage, a casing, a plunger, a plunger body and a plunger pump, wherein the suction tube conveys liquid from that part of the container that is at the bottom in the upright position of the container to the lower suction aperture, the lower suction aperture conveys the liquid from the suction tube to the suction valve, the upper suction aperture conveys the liquid from the suction valve to the conveying chamber, the conveying chamber conveys the liquid from the upper suction aperture to the outlet passage, and the outlet passage conveys the liquid from the conveying chamber to the open air by way of the outlet passage extending through the plunger and the plunge body in an axial direction, the casing capable of being positioned in a liquid-tight manner in the container aperture;

said apparatus further comprising an auxiliary valve casing having a secondary passage, the secondary passage leading from a part of the container chamber that is at the top in the upright position of the container to the lower suction aperture of the suction valve;

said apparatus further comprising a gravity-actuated auxiliary valve formed in the secondary passage and at least partially defined by the auxiliary valve casing, an auxiliary valve closing member and an axial slot, said auxiliary valve being separate from the pump casing and arranged between the pump casing and the suction tube, wherein the auxiliary valve blocks the secondary passage in the upright position of the container, closing the auxiliary valve and frees the passage, in the position when the container is reversed by about 180° with respect to the upright position of the container, opening the auxiliary valve and allowing liquid to flow through the secondary passage to the lower suction aperture and to the conveying chamber.

26. The apparatus of claim 25, wherein in the upright position, the plunger opens the suction valve when released after being depressed, the suction valve otherwise being closed, and in the position when the container is reversed by about 180° with respect to the upright position of the container, the plunger closes the suction valve when depressed, the suction valve otherwise being open, allowing liquid to flow through the suction valve to the conveying chamber.

27. The apparatus of claim 25, wherein the auxiliary valve casing lies essentially within the cross-sectional outline of the pump casing.

* * * * *